US005682575A

United States Patent [19]

Komori

[11] Patent Number: 5,682,575

[45] Date of Patent: Oct. 28, 1997

[54] ELECTROPHOTOGRAPHIC RECORDING APPARATUS HAVING TRANSFER VOLTAGE CONTROL DEVICE

[75] Inventor: Chihiro Komori, Tokyo, Japan

[73] Assignee: Oki Electric Industry Co., Ltd., Tokyo, Japan

[21] Appl. No.: 319,509

[22] Filed: Oct. 6, 1994

[30] Foreign Application Priority Data

Oct. 8, 1993 [JP] Japan ..... 5-253380

[51] Int. Cl.[6] ..... G03G 15/16

[52] U.S. Cl. ..... 399/66; 399/88

[58] Field of Search ..... 355/208, 274, 355/277, 273; 399/66, 88, 313, 314

[56] References Cited

U.S. PATENT DOCUMENTS

| | | | |
|---|---|---|---|
| 4,338,017 | 7/1982 | Nishikawa | 355/272 |
| 5,099,287 | 3/1992 | Sato | 355/274 |
| 5,291,253 | 3/1994 | Kumasaka et al. | 355/275 |

FOREIGN PATENT DOCUMENTS

| | | |
|---|---|---|
| 0 404 079 | 12/1990 | European Pat. Off. . |
| 0512544 | 11/1992 | European Pat. Off. . |
| 512544 | 11/1992 | European Pat. Off. . |
| 0 520 819 | 12/1992 | European Pat. Off. . |
| 0532344 | 3/1993 | European Pat. Off. . |
| 4040692 | 6/1991 | Germany . |
| 56-14271 | 2/1981 | Japan . |
| 56-69652 | 6/1981 | Japan . |
| 1-265282 | 10/1989 | Japan . |
| 1265282 | 10/1989 | Japan . |
| 4-25885 | 1/1992 | Japan . |
| 4025885 | 1/1992 | Japan . |
| 4-168465 | 6/1992 | Japan . |
| 5011646 | 1/1993 | Japan . |
| 5297740 | 11/1993 | Japan . |
| 6-202499 | 7/1994 | Japan . |

*Primary Examiner*—Nestor R. Ramirez

*Attorney, Agent, or Firm*—Panitch Schwarze Jacobs & Nadel, P.C.

[57] ABSTRACT

An electrophotographic recording apparatus comprises a photosensitive drum, a transfer roller, a high voltage power supply circuit for applying a transfer voltage to the transfer roller and a CPU for controlling the entire apparatus. The high voltage power supply circuit supplies an output voltage corresponding to a control signal issued from the CPU as the transfer voltage to the transfer roller. At this time, the high voltage power supply circuit sends a current detection signal to the CPU to inform the same of an output current which flows to the transfer roller. On the other hand, the CPU outputs a control signal to the high voltage power supply circuit, the control signal corresponding to said current detection signal output from the high voltage power supply circuit. As a result, even if the output current is varied depending on the kind of the print medium and the resistance of the transfer roller, it is possible to generate the output voltage in accordance with the varied output current.

28 Claims, 12 Drawing Sheets

FIG. 8

| CURRENT VALUE $I_1$ (AVERAGE) [μA] | CURRENT VALUE $I_2$ (AVERAGE) [μA] | | | | | | | | | | |
|---|---|---|---|---|---|---|---|---|---|---|---|
| | 1 OVER | ~1.5 | ~2 | ~2.5 | ~3 | ~3.5 | ~4 | ~4.5 | ~5 | ~5.5 | 5.5 OVER |
| 3 OVER | 2.3 [kV] | 1.98 [kV] | 1.65 [kV] | 1.54 [kV] | 1.43 [kV] | 1.38 [kV] | 1.33 [kV] | 1.30 [kV] | 1.26 [kV] | 1.13 [kV] | 1 [kV] |
| 2 ~ 3 | 2.5 [kV] | 2.18 [kV] | 1.85 [kV] | 1.74 [kV] | 1.63 [kV] | 1.58 [kV] | 1.53 [kV] | 1.5 [kV] | 1.46 [kV] | 1.33 [kV] | 1.2 [kV] |
| 2 UNDER | 3.2 [kV] | 2.78 [kV] | 2.35 [kV] | 2.21 [kV] | 2.07 [kV] | 2 [kV] | 1.93 [kV] | 1.89 [kV] | 1.84 [kV] | 1.67 [kV] | 1.5 [kV] |

ELECTROPHOTOGRAPHIC RECORDING APPARATUS HAVING TRANSFER VOLTAGE CONTROL DEVICE

BACKGROUND OF THE INVENTION

1. Field of the Invention

The present invention relates to an electrophotographic recording apparatus such as an electrophotographic printer or an electronic copier.

2. Description of the Related Art

An electrophotographic recording apparatus has a photosensitive drum. The surface of the photosensitive drum is first subjected to an electrostatic charge, then light is selectively given to the surface of the photosensitive drum by an exposure machine, thereby forming an electrostatic latent image thereon. The electrostatic latent image is developed when a developing machine supplies toner onto the surface of the photosensitive drum. When a medium such as paper, etc. is passed between the photosensitive drum and the developing machine, toner is attracted toward the medium from the photosensitive drum to be transferred onto the medium, thereby performing printing.

FIG. 2 is a view for explaining a transfer process. In the same figure, an electrostatic latent image formed on a photosensitive drum 11 is developed by a developing machine 12. A developed toner image is transferred onto a printing medium 15 by a transfer roller 13, which is subjected to an electrostatic charge by a transfer power source 14, so that the toner image is formed on the printing medium 15. A toner 16 on the printing medium 15 is thereafter fixed to the printing medium 15 by a fixing machine, not shown.

Inasmuch as transfer efficiency of the toner 16 from the photosensitive drum 11 onto the printing medium 15 is varied according to conditions at the time of transfer such as size of the medium, thickness of the medium, atmospheric humidity, and atmospheric temperature, it is necessary to change a voltage value to be applied from the transfer power source 14 to the transfer roller 13 (hereinafter referred to as transfer voltage) in accordance with these conditions.

For example, an envelope needs higher transfer voltage than a cut sheet of A4-size since the former is narrower and thicker than the latter.

SUMMARY OF THE INVENTION

Accordingly, it is an object of the invention to detect a value corresponding to a resistance value of a print medium which is inserted between the photosensitive drum and the developing machine, thereby obtaining a desired transfer voltage.

It is another object of the invention to detect the resistance value of the print medium by a high voltage power supply circuit per se for applying the transfer voltage to a transfer roller, thereby obtaining a desired transfer voltage.

It is still another object of the invention to estimate the resistance value of the print medium to thereby obtain a desired transfer voltage even in case that the resistance value is not directly measured because of instability of current supplied from the high voltage power supply circuit to the print medium.

A first aspect of the present invention is an electrophotographic recording apparatus which includes a photosensitive drum and a transfer roller confronting the photosensitive drum and comprises the following elements:

a high voltage power supply circuit for applying a transfer voltage to the transfer roller;

a control circuit for receiving information of the electrophotographic recording apparatus including one at least regarding to either of output voltage value and output current value of the high voltage power supply circuit and controlling a voltage value output from the high voltage power supply circuit;

wherein the control circuit calculates a value corresponding to the voltage value to be applied to the transfer roller based on a value which is varied in correspondence with a resistance value of the transfer roller and a resistance value of the print medium and outputs a control signal for controlling the voltage value which is supplied by the high pressure power supply circuit based on the calculated value.

Another aspect of the present invention is a method of transferring toner image in an electrophotographic recording apparatus which includes a photosensitive drum and a transfer roller confronting the photosensitive drum, wherein the method comprises the following steps:

a step of measuring a resistance value of the transfer roller before a print medium is introduced into the electrophotographic recording apparatus;

a step of inserting the print medium between the photosensitive drum and the transfer roller;

a step of detecting a current value B1 at a first time immediately after the medium is inserted between the photosensitive drum and the transfer roller and a current value A1 which is varied during a very short period of time close to the first time while a constant voltage V0 is applied to the transfer roller;

a step of detecting a current value B2 at a second time before the variation of current comes to an end after the first time and a current value A2 which is varied during a very short period of time close to the second time;

a step of calculating a resistance value Rm of the medium using a calculation formula: $Rm=\{(B2/B1)-1\}/\{(A2/A1)-(B2/V0)\}$; and a step of applying a voltage value to the transfer roller, the voltage valve corresponding to a combined resistance of the resistance value of the transfer roller and the resistance value of the print medium.

Figure 5:
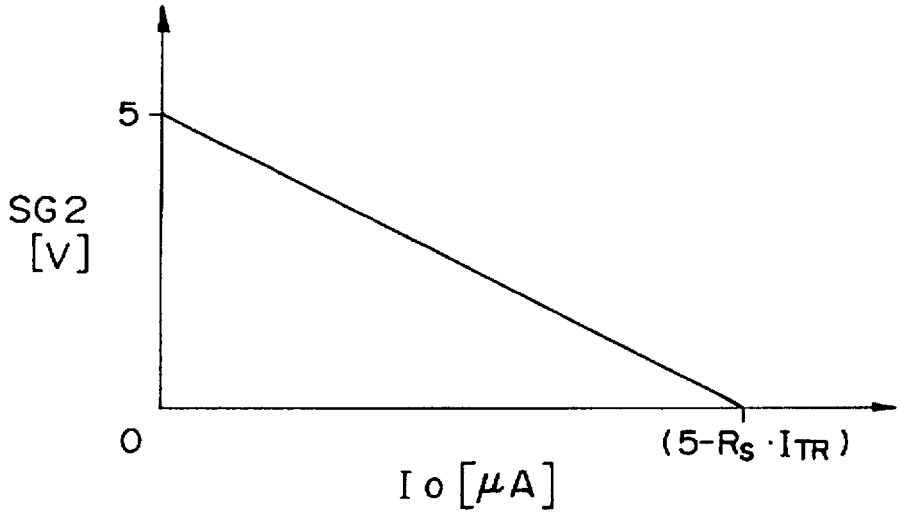
Figure 6:
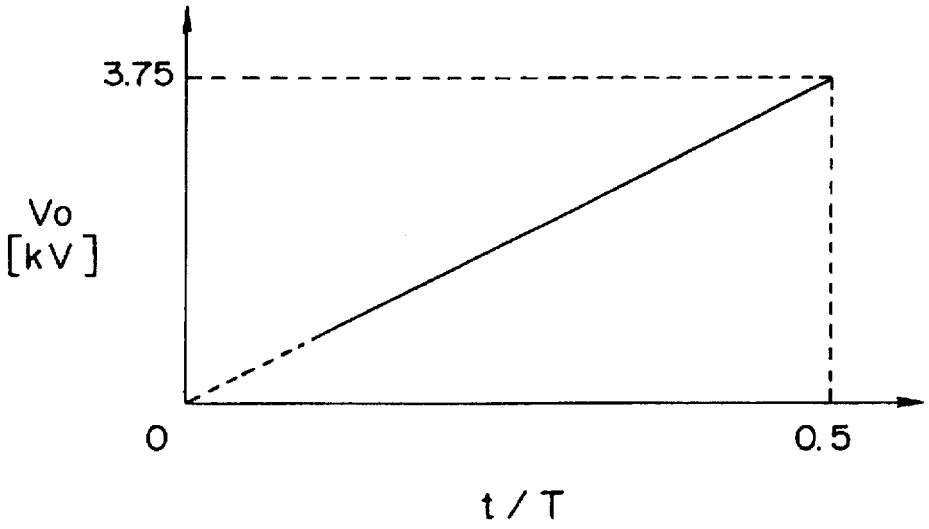
Figure 7:
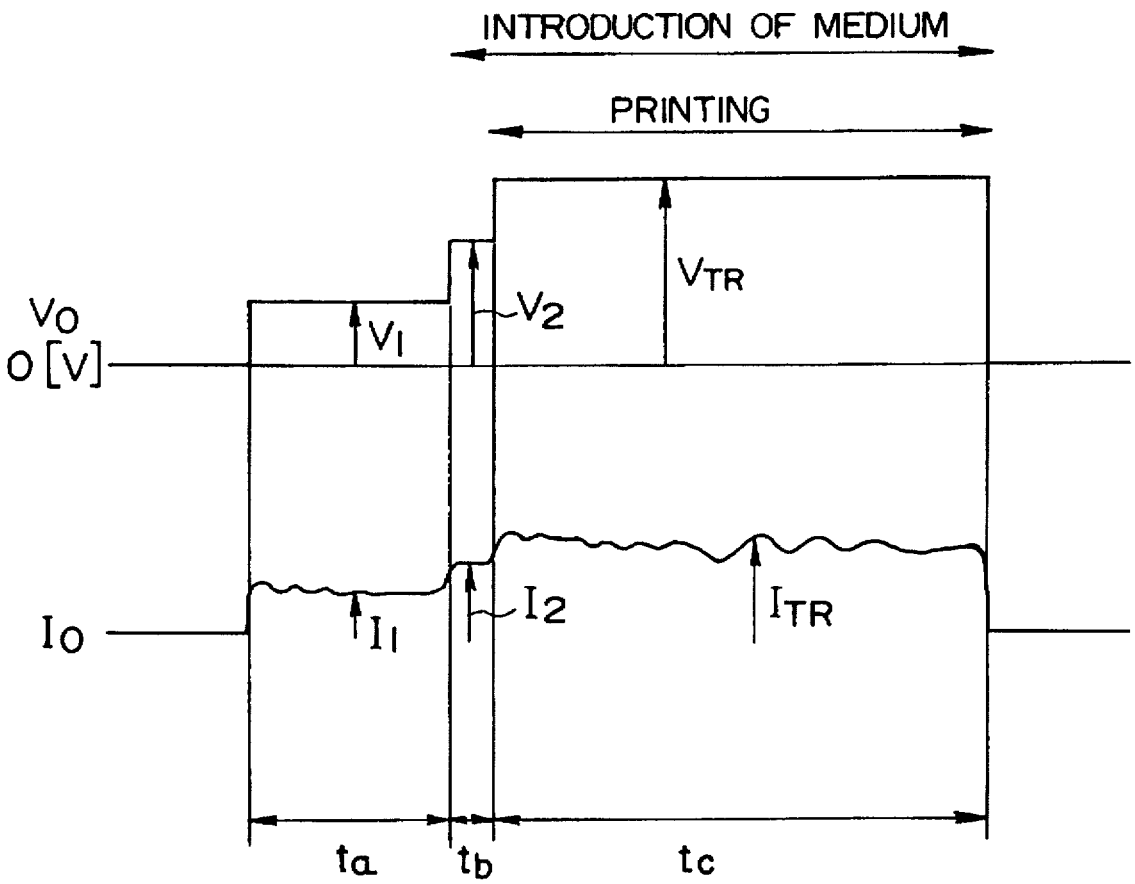
Figure 9:
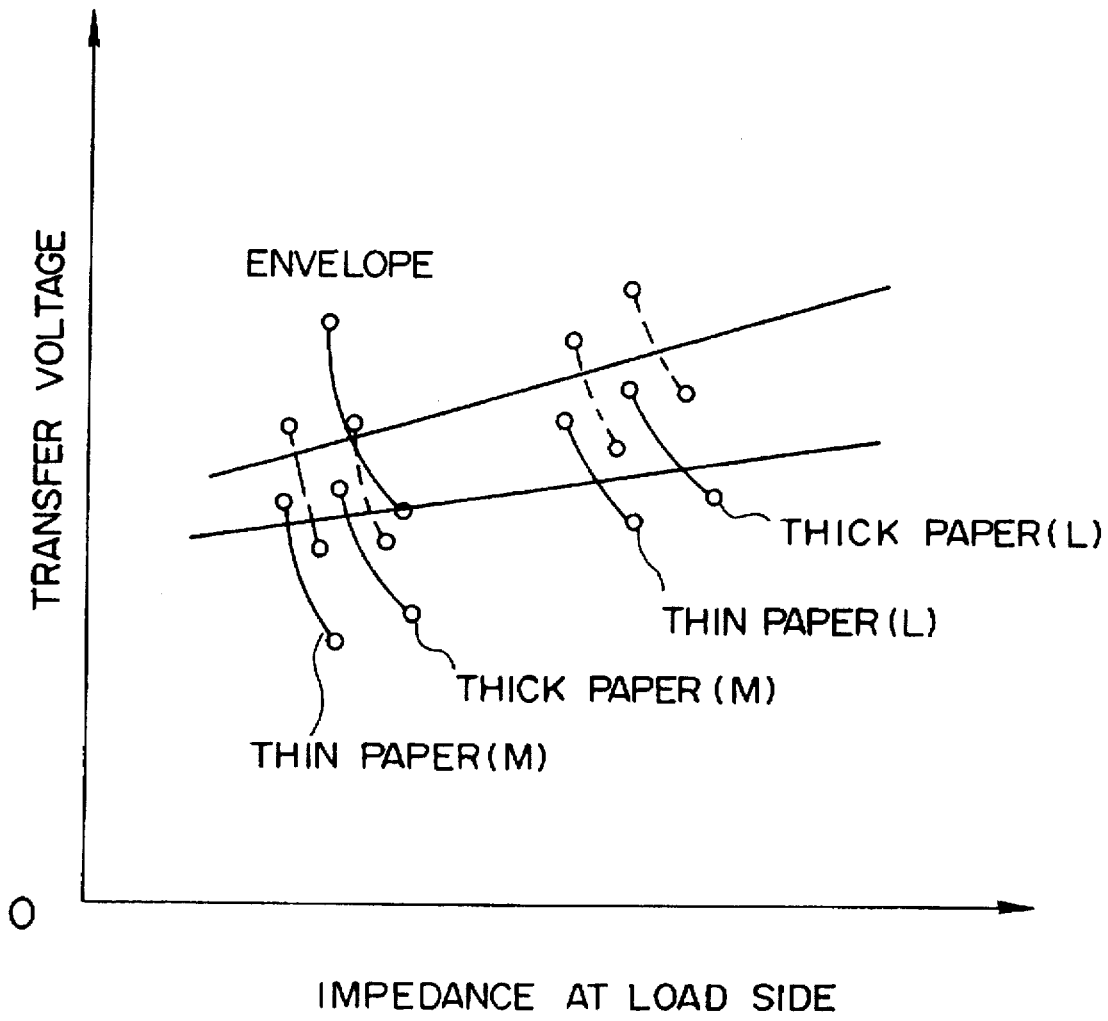
Figure 10:
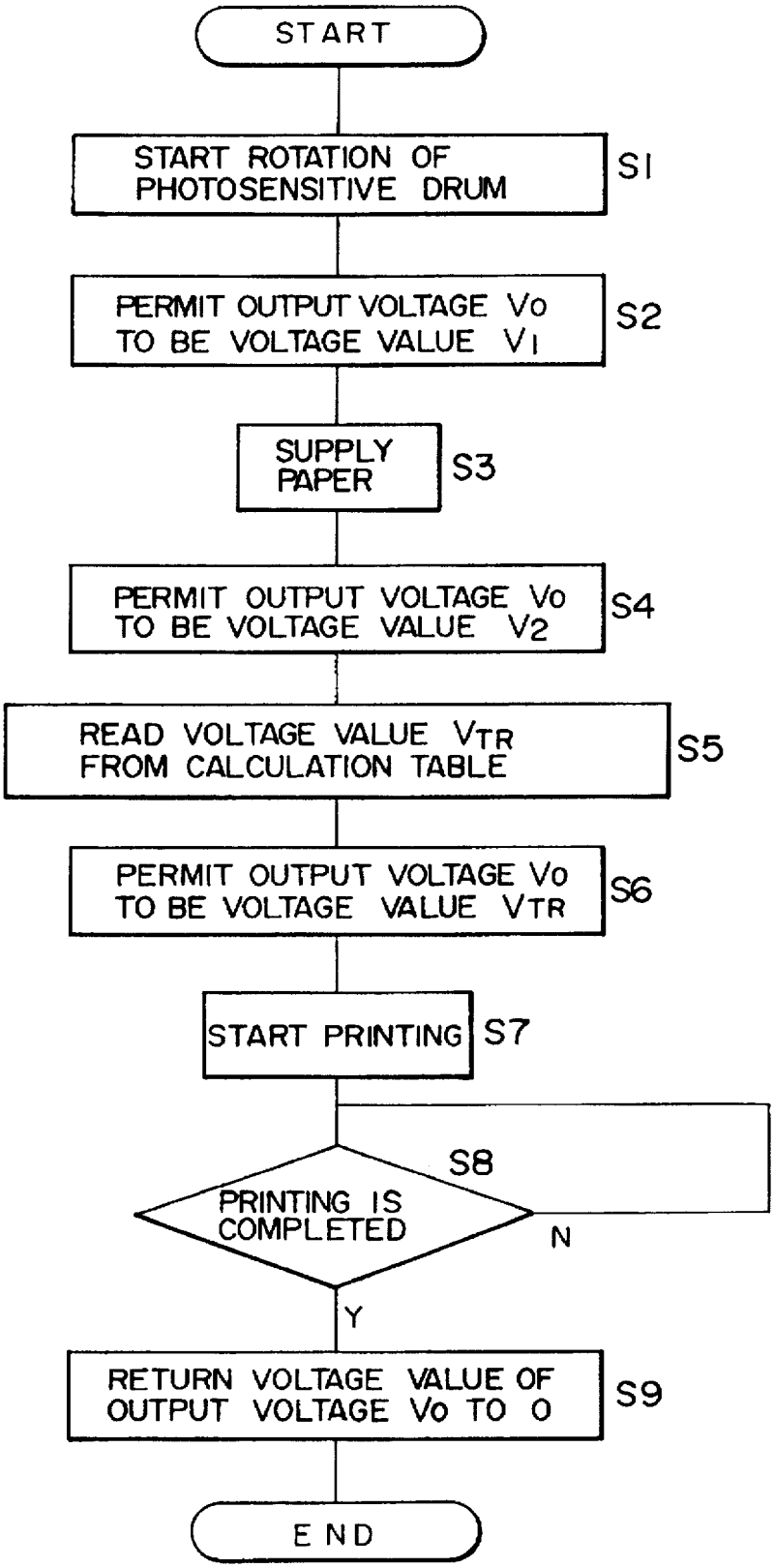
Figure 11:
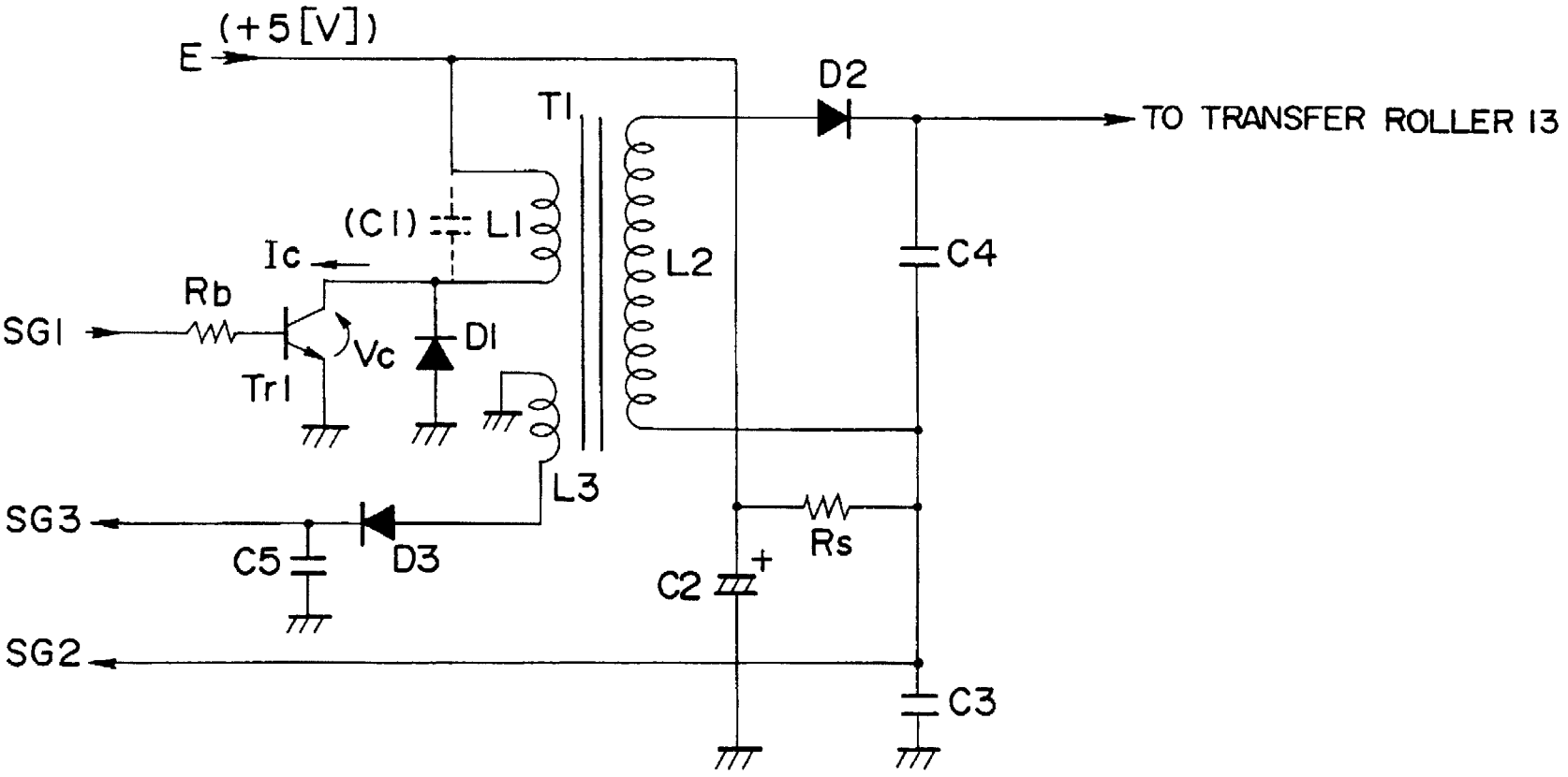
Figure 12:
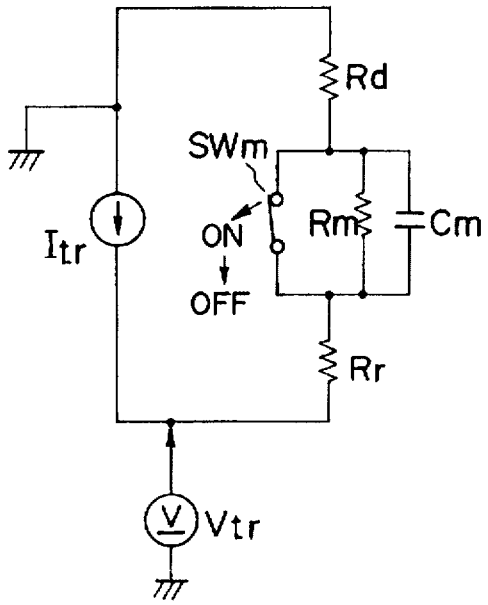
Figure 13:
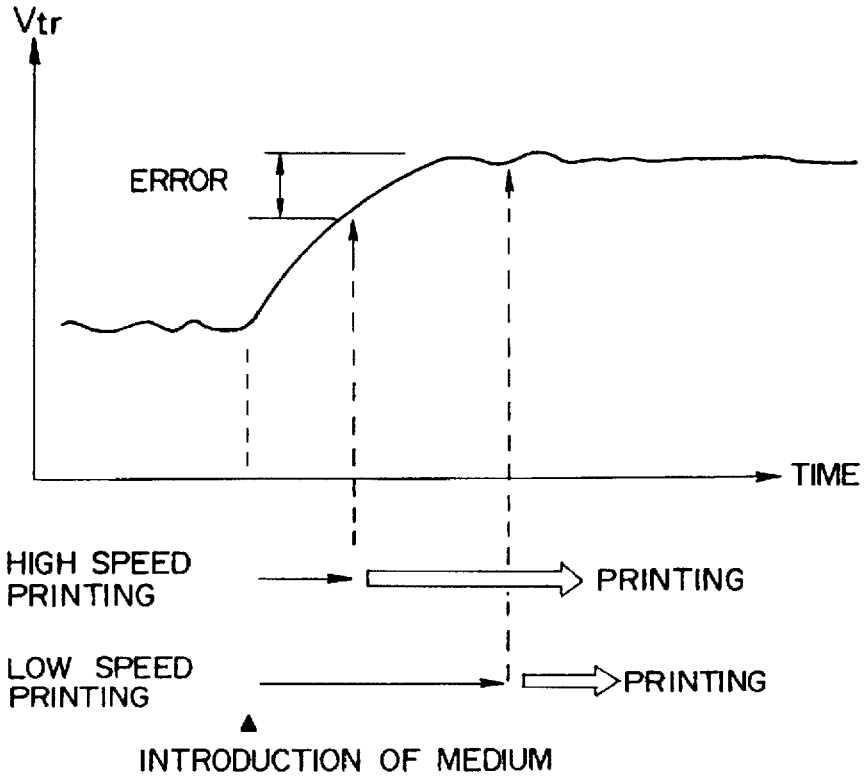
Figure 14:
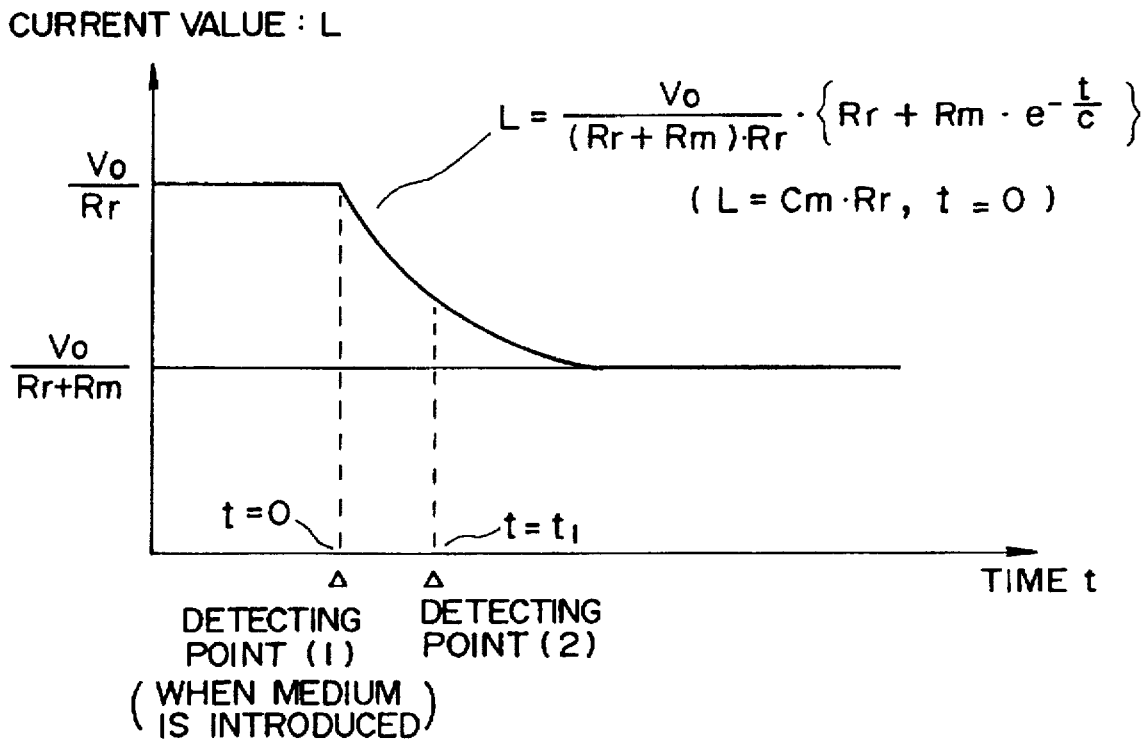
Figure 15:
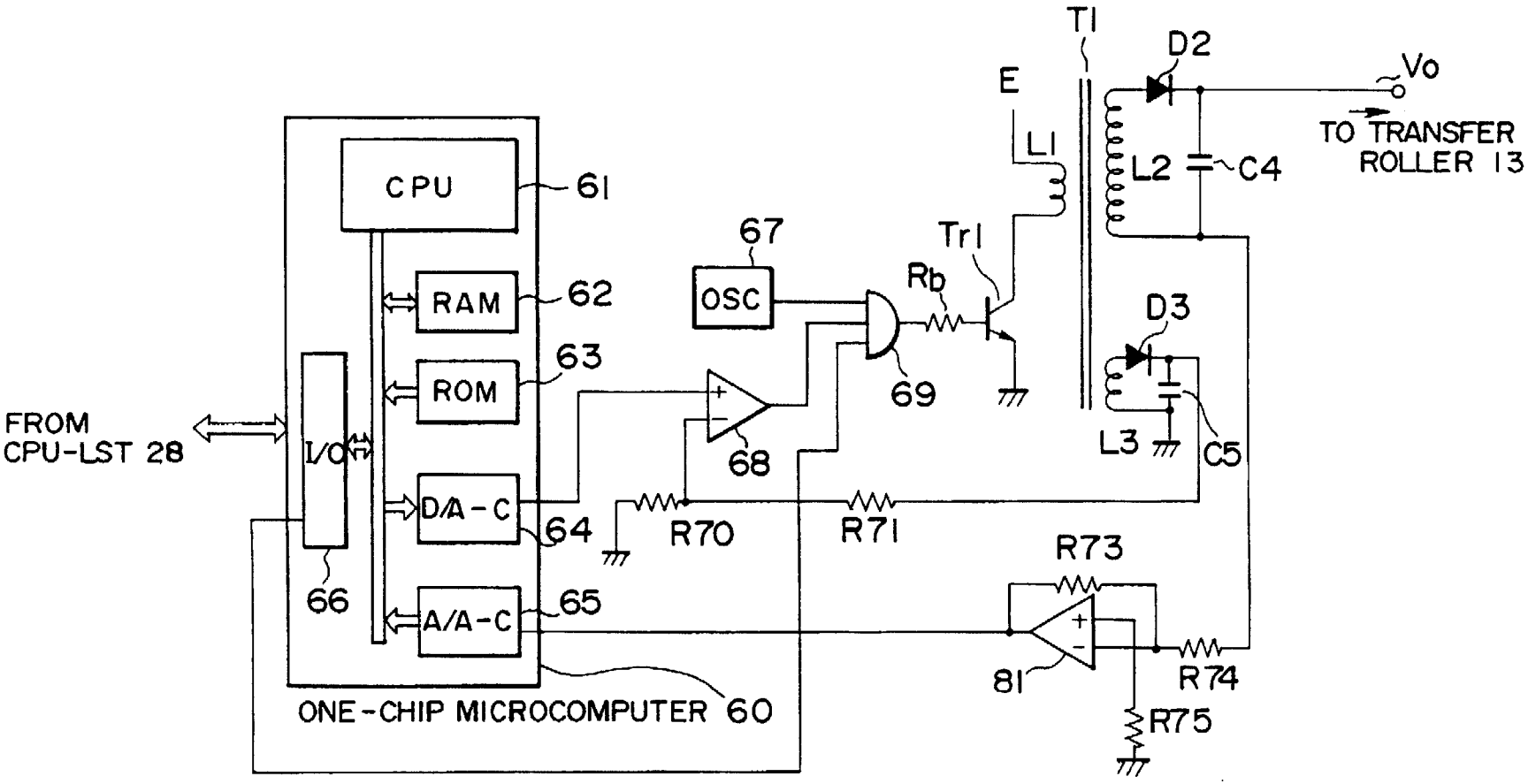

FIGS. *4a–4c* are timing charts of the high voltage power supply circuit;

FIG. 5 is a graph showing relation between current output from the high voltage power supply circuit and a detected current;

FIG. 6 is a graph showing characteristics of a pulse width modulation signal and the output voltage of the high voltage power supply circuit according to the first embodiment of the present invention;

FIG. 7 is a timing chart of the output voltage and output current according to the first embodiment of the present invention;

FIG. 8 is a calculation table showing transfer voltages according to the first embodiment of the present invention;

FIG. 9 is a view showing characteristic of an electrophotographic printer according to the first embodiment of the present invention;

FIG. 10 is a flow chart for explaining control procedure according to the first embodiment of the present invention;

FIG. 11 is a circuit diagram of a high voltage power supply circuit according to a second embodiment of the present invention;

FIG. 12 is a circuit diagram of an equivalent circuit of a transfer apparatus according to a third embodiment of the present invention;

FIG. 13 is a view showing variation of voltage Vtr when a given current is supplied to a transfer roller in FIG. 12;

FIG. 14 is a graph showing variation of current which flows to the transfer roller when the medium is inserted between the photosensitive drum and the transfer roller in FIG. 12; and FIG. 15 is a circuit diagram of a high voltage power supply circuit according to a fourth embodiment of the present invention.

PREFERRED EMBODIMENTS

First Embodiment (FIGS. 1–10)

Figure 1:
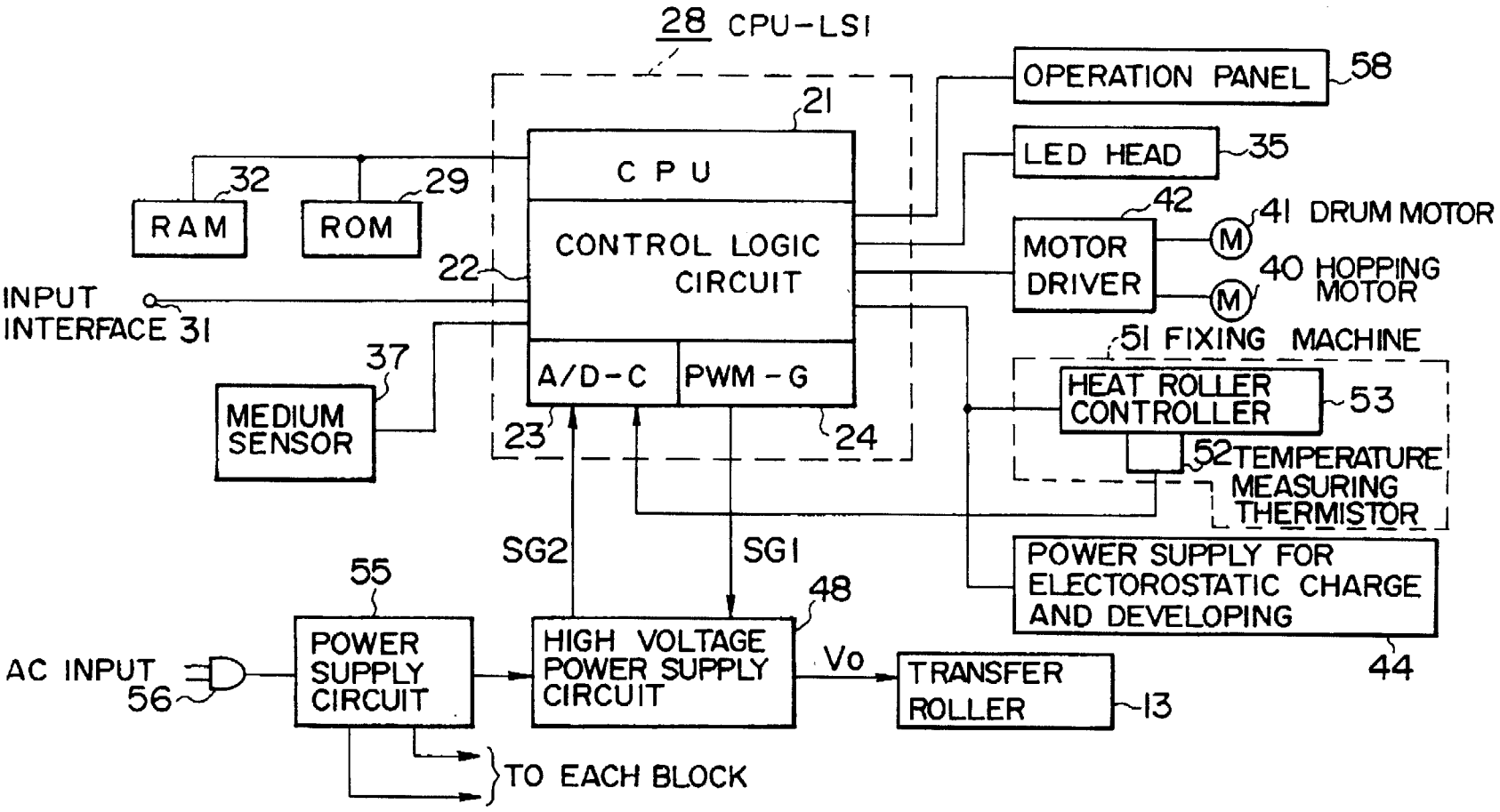
FIG. 1 is a block diagram for explaining an electrophotographic recording apparatus according to a first embodiment of the present invention.

An electrophotographic recording apparatus includes a control circuit as shown in FIG. 1 for controlling operations of a photosensitive drum 11, a developing machine 12, a transfer roller 13, a transfer power source 14, etc.

FIG. 1 is a block diagram for explaining an electrophotographic recording apparatus according to a first embodiment of the present invention. As the electrophotographic recording apparatus, an electrophotographic printer is exemplified and an operation of the electrophotographic printer will be described hereinafter.

A control circuit for controlling an entire electrophotographic printer is a one-chip CPU-LSI 28 comprising a CPU 21, a control logic circuit 22, an A/D converter 23 (A/D-C), and a pulse width modulation signal generator 24 (PWM-G) which are all mounted on a single silicon semiconductor.

A control program for operating the CPU-LSI 28 is stored in a ROM 29 and printing is performed according to the control program.

The control logic circuit 22 receives a print date from a host unit such as a personal computer by way of an input interface 31. The control logic circuit 22 further receives information detected by various medium sensors 37 and a set value of an operation panel 58.

The control logic circuit 22 outputs a dot data to be printed to an LED head 35 so that the LED head 35 can perform an exposure and outputs a control signal to a motor driver 42 so that the motor driver 42 can control a hopping motor 40 and a drum motor 41. The control logic circuit 22 further outputs a control signal to a heat controller 53 so that the heat controller 53 can control a temperature of a fixing machine 51. The control logic circuit 22 still further outputs a control signal to a charging/developing power source 44 so as to control a voltage value for electrostatic charge or developing.

The A/D converter 23 receives a detection signal SG2 comprising a voltage value corresponding to a current value output from a high voltage power supply circuit 48 to the transfer roller 13 and a voltage value corresponding to temperature detected by a temperature measuring thermistor 52 which is provided together with the heat controller 53 in the fixing machine 51.

The pulse width modulation signal generator 24 outputs a pulse width modulation signal SG1 corresponding to the voltage value output from the high voltage power supply circuit 48.

An operation of the CPU-LSI 28 will be described hereinafter.

The CPU-LSI 28 receives the above print information by way of an input interface and stores the print information temporarily in a RAM 32. The CPU-LSI 28 converts the print information stored in the RAM 32 into a dot data based on the information stored in a ROM 29 and stores again the dot data in another area of the RAM 32. The CPU-LSI 28 transfers the dot data to the LED head 35 in a given timing for performing exposure.

Moreover, the CPU-LSI 28 supplies a print medium to the electrophotographic printer in accordance with the conversion of the print information into the dot data.

The CPU-LSI 28 receives detection signals output from the various medium sensors 37 provided at the various positions for detecting presence or nonpresence of the medium and width of the medium, introducing the medium from a medium cassette and discharging the medium from a discharge port of the electrophotographic printer. When the medium is contained in the medium cassette, not shown, the CPU-LSI 28 controls the motor driver 42 so that the motor driver 42 drives the hopping motor 40 and drum motor 41 to feed the medium in a printing direction.

The CPU-LSI 28 outputs a pulse width modulation signal SG1 to thereby control the high voltage power supply circuit 48 so that the high voltage power supply circuit 48 applies the transfer voltage to the transfer roller 13.

The CPU-LSI 28 performs such various controls so as to sequentially perform exposing, developing, transferring and fixing processes for electrophotographic printing.

A power supply circuit 55 is a circuit for transforming a voltage of a commercial power source received through an AC input 56 thereof into stable voltages to be supplied to the high voltage power supply circuit 48 and other blocks in the electrophotographic printer as power source voltages.

Figure 3:
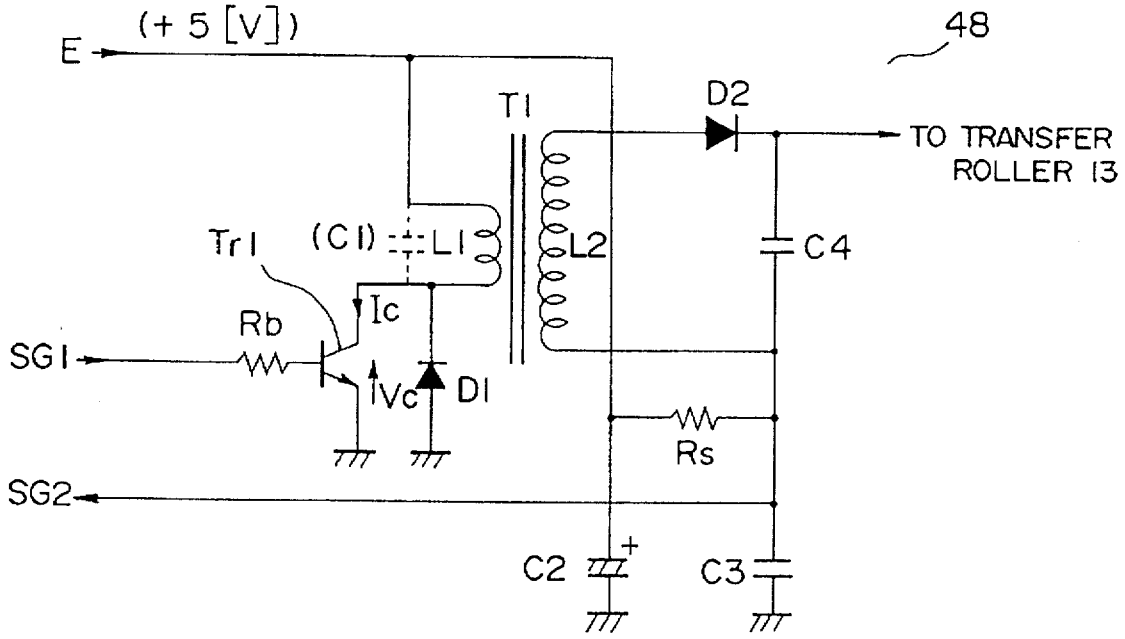
FIG. 3 is a circuit diagram of a high voltage power supply circuit according to the first embodiment of the present invention.

FIG. 3 is a circuit diagram of the high voltage power supply circuit 48 according to the first embodiment of the present invention.

The high voltage power supply circuit 48 includes a transformer T1 composed of a primary coil L1 for receiving a power source E of +5V and a secondary coil L2 which is larger than the primary coil L1 in number of turns for generating a voltage larger than that of the primary coil L1 in the secondary coil L2.

Connected to the ground side of the primary coil L1 are an inverse diode D1 and a transistor Tr1 which receives the pulse width modulation signal SG1 by way of a resistor Rb at a base terminal thereof. The primary coil L1 and its distributed capacity constitute a resonance circuit, the distributed circuit serving as a resonance capacitor C1 in an equivalent circuit.

A rectifier diode D2 and a smoothing capacitor C4 are connected to the output side of the secondary coil L2 and a noise filter capacitor C3 is connected to the smoothing capacitor C4 in series.

A current detecting resistor Rs is connected between a power source E and the ground side end of the smoothing capacitor C4 while a by-pass capacitor C2 for the high voltage power supply circuit 48 is connected between the power source E and the ground.

An operation of the high voltage power supply circuit 48 will be described with reference to FIGS. 3 and 4.

Figure 4A:
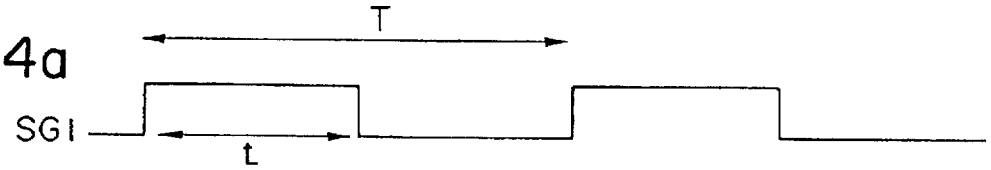
Figure 4B:
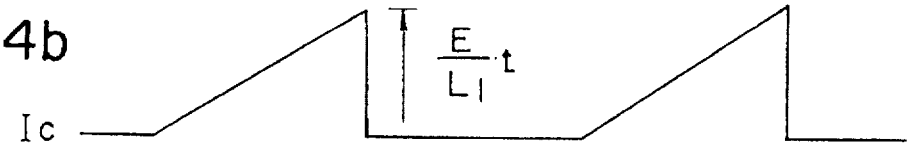
Figure 4C:
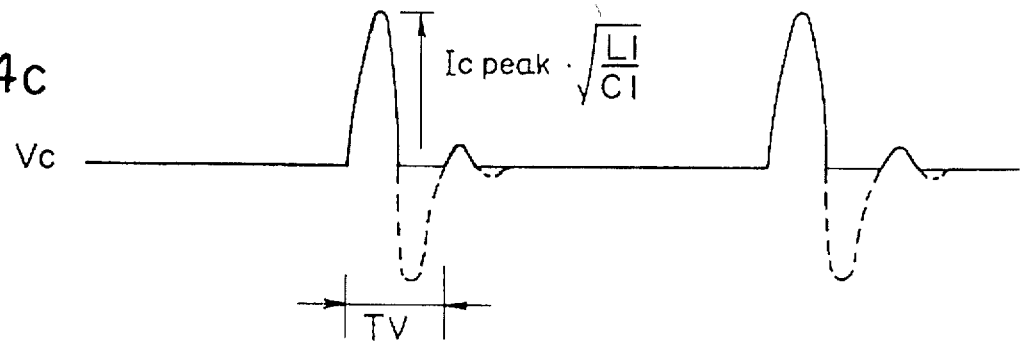

FIGS. 4a–4c are timing charts of the high voltage power supply circuit 48.

The pulse width modulation signal SG1 as shown in FIG. 4a is applied to the base terminal of the transistor Tr1 as shown in FIG. 3 by way of the resistor Rb which is provided for restricting the base current of the transistor Tr1. The pulse width modulation signal SG1 having a given cycle T is controlled in such a way as to prolong ON time t in the cycle T for outputting a high voltage and curtail the ON time t in the cycle T for outputting a low voltage. That is, the output voltage is controlled by the ratio of the ON/OFF times. Current from the power source E intermittently flows in the primary coil L1 of the transformer T1 under the ON/OFF control of the transistor Tr1.

The voltage of the primary coil L1 is multiplied by a ratio of the number of turns between the primary coil L1 and the secondary coil L2 to be output from the secondary coil L2. The current which flows from the secondary coil L2 is rectified by the rectifier diode D2 and is smoothed by the smoothing capacitor C4 so that an output voltage V0 is output from the high voltage power supply circuit 48 to be applied to the transfer roller 13.

At this time, a current which flows to the transfer roller 13, namely, an output current passes through the current detecting resistor Rs. A voltage $V_{sg2}$ of the detection signal SG2 of the output current is expressed as follows as shown in FIG. 5.

$$V_{sg2}=5-I0\cdot rs$$

wherein rs is a resistance value of the current detecting resistor Rs.

FIG. 5 is a graph showing the relation between the current I0 which is output from the high voltage power supply circuit 48 and the $V_{sg2}$.

As shown in FIG. 5, supposing that $$rs=500[K\Omega]$$

$$I0=10[\mu A]$$

the following expression is established.

$$V_{sg2}=0[V]$$

Supposing that $$I0=0[\mu A],$$

the following expression is established.

$$V_{sg2}=5[V]$$

Accordingly, the CPU-LSI 28 can detect the $V_{sg2}$ by way of the A/D converter 23 to monitor the output current I0.

As shown in FIGS. 4a–4c, when the transistor Tr1 is turned on by the pulse width modulation signal SG1, current flows to the primary coil L1 and the current value of the primary coil L1 increases as time passes supposing that the inductance of the primary coil L1 is L1, the current value becoming after a time t:

$$Ic=(E*t)/L1$$

If the transistor Tr1 is thereafter turned off, resonance occurs in a resonance circuit constituted of the inductance L1 of the primary coil L1 and a capacitance C1 of the resonance capacitor C1 which is the distribution capacitance of the primary coil L1 of the transformer T1 in equivalent circuit. At this time, a peak value $Vc_{peak}$ of the collector voltage Vc is the peak value $Ic_{peak}$ of the collector current Ic multiplied by $\sqrt{L1/C1}$ so that the following expression is established;

$$\begin{aligned} Vc_{peak} &= Ic_{peak}\cdot\sqrt{L1/C1} \\ &= E\cdot t/\sqrt{L1\cdot C1} \end{aligned}$$

and resonance having a frequency fv of about $1/2\pi\sqrt{L1\cdot C1}$ is generated. In this case, the negative half-cycle of the oscillating wave is clipped by the inverse diode D1 as shown in FIG. 3 and the collector voltage Vc is sharply attenuated.

It is understood from the expression (1) that the $Vc_{peak}$ of the collector voltage Vc is increased in proportion to the lapse of time during which the collector current Ic flows.

Supposing that the cycle T of the pulse width modulation signal SG1 is 50 [μs], the frequency f is 20 [kHz], maximum value of t is 25 [μs], the primary coil inductance L1 of the transformer T1 is 500 [μH], the equivalent capacity C1 of the primary coil L1 of the transformer T1 due to the distribution capacitance thereof is 2000 [pF], the voltage of the power source E is 5 [V] and the turn ratio of the transformer T1 is 1:30, the following expressions are established.

resonance cycle Tv=6.3 [μs]

The peak value $Ic_{peak}$ of the collector current Ic=250 [mA]

(Average maximum value is 63 [mA])

The peak value $Vc_{peak}$ of the collector voltage Vc=125 [Vs]

Maximum value of the output voltage V0=3.75 [kV] (Vc peak×30)

At this time, the current I0 which flows in the transfer roller 13 is very small, i.e. several [μA] to 10 [μA] since the printing medium 15 is inserted between the transfer roller 13 and the photosensitive drum 11 so that an output energy is, e.g., about 38 [mW]. On the other hand, an input energy is sufficiently large since it is expressed as follows.

$$0.25\ [A]\times(1/2)\times(1/2)\times 5\ [V]=312\ [mW]$$

Accordingly, even if the output current I is varied, the voltage variation of the output voltage V0 is very little since a sufficient power is supplied from the primary coil L1.

Since the high voltage power supply circuit 48 having the arrangement as set forth above is subjected to a feedback control so as to supply a given voltage, it is not necessary to always detect the output voltage, which dispenses with the provision of an additional feedback control circuit. Further, it is not necessary to apply load to the CPU-LSI 28 instead of providing the additional feed back control circuit. Accordingly, it is possible to realize the high voltage power supply circuit 48 which can output a stable high voltage power supply by a simple circuit.

As mentioned above, the output voltage V0 is determined by the inductance L1, the equivalent capacitance C1 which is used as the resonance capacitor, the power supply voltage E and the time t. As a result, the relation between the pulse width modulation signal SG1 and the output voltage V0 of the high voltage power supply circuit 48 is established as shown in FIG. 6.

FIG. 6 is a graph showing characteristics of a pulse width modulation signal and the output voltage of the high voltage power supply circuit 48 according to the first embodiment of the present invention. As shown in FIG. 6, the output voltage V0 is proportional to the pulse width modulation signal SG1.

Although the distribution capacitance of the primary coil L1 is used as the resonance capacitor C1 in an equivalent circuit in the above example, it is necessary to provide another capacitor in parallel with the primary coil L1 if the distribution capacitance of the primary coil alone is not sufficient for the resonance capacitor C1.

An operation of the transfer roller 13 will be explained hereinafter.

FIG. 7 is a timing chart of the output voltage and output current according to the first embodiment of the present invention. In FIG. 7, denoted at V0 and I0 in the vertical axis are output voltage value and output current value of the high voltage power supply circuit 48 and the lateral axis represents time.

Figure 2:
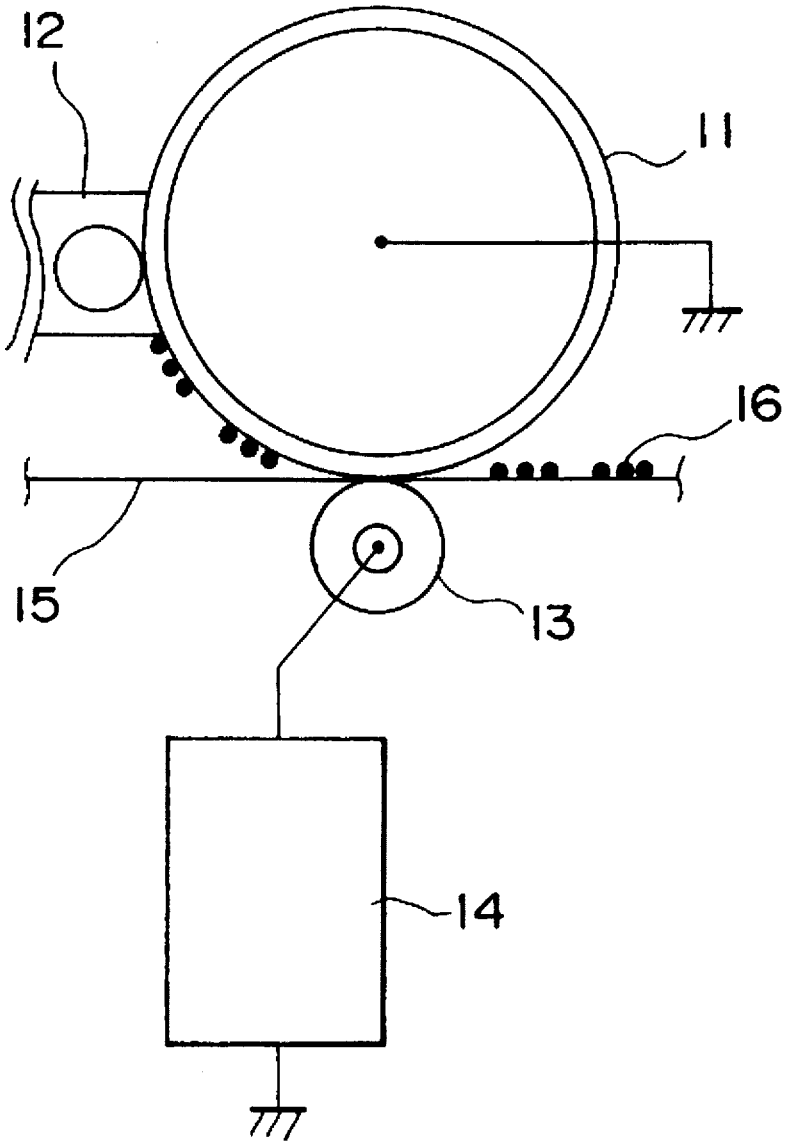
FIG. 2 is a schematic view of the electrophotographic recording apparatus for explaining a transfer process.

When printing operation starts and the photosensitive drum 11 shown in FIG. 2 starts to turn, the pulse width modulation signal generator 24 shown in FIG. 1 generates the pulse width modulation signal SG1 and the high voltage power supply circuit 48 varies the output voltage V0 to a voltage V1 corresponding to the pulse width modulation signal SG1 only during a time ta. At this time, the current value of the output current I0 becomes I1, which is input to the CPU-LSI 28 as the detection signal SG2 to be monitored thereby. As a result, it is possible to calculate the resistance value of the transfer roller 13 per se.

When the printing medium 15 is fed and inserted between the photosensitive drum 11 and the transfer roller 13, the high voltage power supply circuit 48 varies the output voltage V0 to the voltage value V2 only during a time tb. At this time, the current value of the output current I0 becomes I2, which is also input to the CPU-LSI 28 as the detection signal SG2 to be monitored thereby. As a result, it is possible to calculate the combined resistance value of the transfer roller 13 and the printing medium 15.

The CPU-LSI 28 can calculate the resistance value of the printing medium 15 based on the resistance value at the state where the printing medium 15 is not present and the resistance value at the state where the printing medium 15 is present. The voltage VTR during printing can be calculated based on the resistance value.

In concrete, since the current values I1 and the I2 are detected relative to previously determined voltage values V1 and V2 respectively, the voltage VTR during printing can be obtained by way of a calculation table as shown in FIG. 8 without calculating the resistance value.

FIG. 8 is the calculation table showing transfer voltages according to the first embodiment of the present invention.

This calculation table can be stored in the ROM 29 in FIG. 1 and the voltage VTR during printing can be read out therefrom based on the detected current values I1 and I2. The pulse width modulation signal generator 24 generates the pulse width modulation signal SG1 corresponding to the voltage VTR during printing and the high voltage power supply circuit 48 keeps the output voltage V0 at the voltage value VTR during a time tc in response to the pulse width modulation signal SG1. At this time, the current value of the current I0 becomes ITR.

The calculation table in FIG. 8 shows the voltage value VTR which is calculated under the condition that the voltage value V1 is 500 [V] and the voltage value V2 is 1 [kV] according to the first embodiment.

The calculation table in FIG. 8 is set in the manner that the voltage value VTR is increased as the current values I1 and I2 of the output current I0 are decreased. This means that the resistance value of the transfer roller 13 is large in case the current value I1 is small when the current value I1 and the transfer roller 13 directly brought into contact with each other so as to permit the output voltage V0 to be voltage value V1. In this case, the voltage value VTR must be set to be large. It also means that the resistance value of the printing medium 15 is large in case the current value I2 is small when the printing medium 15 is inserted between the photosensitive drum 11 and the transfer roller 13 so as to permit the output voltage V0 to be voltage value V2. In this case, the voltage value VTR must be set to be large.

Thereafter, the CPU-LSI 28 applies the voltage value VTR to the transfer roller 13 as the transfer voltage by controlling the high voltage power supply circuit 48 to start the printing and returns the output voltage V0 of the high voltage power supply circuit 48 to 0V upon completion of printing.

The voltage value VTR which are set by the calculation table can be changed by operating the operation panel 58. The calculation table can be switched to another one depending on other conditions such as kinds or dimensions of the printing medium 15. For example, the size of the introduced medium is measured by a sensor and the calculation table is changed to another one according to the size of the medium so as to calculate an optimum transfer voltage, which leads to more fine control. Further, the voltage value VTR can be also calculated based on a given formula corresponding to the result of the calculation table instead of reading out the voltage value VTR from the calculation table.

FIG. 9 is a view showing the characteristic of an electrophotographic printer according to the first embodiment of the present invention.

In FIG. 9, solid curved lines respectively show ranges where the transfer is performed effectively in case of using thin paper, thick paper and an envelope as a medium on a normal transfer roller while curved broken lines respectively show ranges where the transfer is performed effectively in case of using the thin paper and the thick paper as the medium on a transfer roller which is larger in resistance value than the normal transfer roller by one or two digits. M in parenthesis shows that peripheral atmosphere of the electrophotographic printer is normal in temperature and humidity while L in parenthesis shows that peripheral atmosphere of the electrophotographic printer is low in temperature and humidity.

As mentioned above, a good transfer operation can be performed by calculating impedance of the medium and selecting the transfer voltage matching the same.

The aforementioned operations are summarized as follows.

FIG. 10 is a flow chart showing a sequence of controls mentioned above.

Step 1: the photosensitive drum 11 starts to rotate.

Step 2: the high voltage power supply circuit 48 (FIG. 1) permits the output voltage V0 to be voltage value V1 during the time ta alone (FIG. 7)

Step 3: the printing medium 15 is fed and inserted between the photosensitive drum 11 and the transfer roller 13

Step 4: the high voltage power supply circuit 48 permits the output voltage V0 to be voltage value V2 during the time tb alone.

Step 5: the CPU-LSI 28 reads out the voltage value VTR corresponding to the current values I1 and I2 from the calculation table shown in FIG. 8.

Step 6: the high voltage power supply circuit 48 permits the output voltage V0 to be the voltage value VTR during the time tc alone.

Step 7: printing starts

Step 8: the CPU 21 judges whether printing is completed or not. If printing is completed, the program goes to Step S9.

Step 9: the high voltage power supply circuit 48 returns the voltage value of the output voltage V0 to 0V.

As mentioned above, according to the first embodiment, the high voltage power supply circuit 48 can calculate the impedance of the transfer roller 13 and that of the printing medium 15 with ease by merely outputting the current value at the time when a given voltage is output as the detection signal SG2 to the A/D converter 23 and also it can set the transfer voltage corresponding to the impedance of the transfer roller 13 and that of the printing medium 15. As a result, it is possible to perform an effective transfer by a simple high voltage power supply circuit 48.

Second embodiment (FIG. 11)

An electrophotographic recording apparatus according to a second embodiment will be described with reference to FIG. 11, which is a circuit diagram of a high voltage power supply circuit.

A high voltage power supply circuit 48-2 of the second embodiment includes a sensor coil L3 for detecting an output voltage in addition to the high voltage power supply circuit 48 of the first embodiment and also includes a rectifier diode D3 and a smoothing capacitor C5 at the output side terminal of the sensor coil L3 from which an output voltage detection signal SG3 is output.

Since the voltage value of the output voltage detection signal SG3 is proportional to the output voltage V0, the CPU-LSI 28 can detect the voltage value of the output voltage detection signal SG3 by way of the A/D converter 23 to monitor the output voltage V0.

In such a manner, the CPU-LSI 28 can monitor the relation between the pulse width modulation signal SG1 and the output voltage V0 caused by the dispersion of the characteristic of parts constituting the high voltage power supply circuit 48-2. Since there is established a linear relation between the pulse width modulation signal SG1 and the output voltage V0, the CPU-LSI 28 can improve the accuracy of the output voltage V0 by monitoring the relation between the pulse width modulation signal SG1 and the output voltage V0 at one point and by performing calibration.

As mentioned above, it is possible to apply the transfer voltage corresponding to the medium to the transfer roller 13 by calculating the resistance value of the medium which is supplied to the electrophotographic recording apparatus or a value corresponding to the resistance value, thereby improving the transfer accuracy. However, it is difficult to measure the resistance value of the medium or the value corresponding thereto if the number of the print mediums per hour is increased.

To solve this problem, the medium resistance is estimated by an arithmetic operation based on difference between the current before the medium is supplied and the current immediately after the medium is supplied to the electrophotographic recording apparatus.

Third Embodiment (FIGS. 12 to 14)

For this purpose, the resistance value of the print medium is measured as described in detail in the following third embodiment.

At first, a problem in measuring the resistance value of the print medium 15 in a short time will be described hereinafter.

FIG. 12 is a circuit diagram of an equivalent circuit of a transfer apparatus according to the third embodiment of the present invention.

In FIG. 12, denoted at Rd is an equivalent resistance of the photosensitive drum 11, Cm is an equivalent capacitance of the medium, Rm is an equivalent resistance of the medium, and Rr is an equivalent resistance of the transfer roller 13.

When the printing medium 15 is inserted between the photosensitive drum 11 and transfer roller 13, the equivalent resistance Rm and the equivalent capacitance Cm of the medium are inserted between the equivalent resistance Rd of the photosensitive drum 11 and the equivalent resistance Rr of the transfer roller 13, which corresponds to a state where a switch SWm is turned off. When the switch SWm is turned off, the transfer voltage is increased by the voltage corresponding to the equivalent resistance Rm of the medium. Accordingly, the transfer voltage is corrected by that corresponding to equivalent resistance Rm if a voltage Vtr is maintained at a given value during printing.

Whereupon, the variation of the voltage Vtr is delayed due to the equivalent capacitance Cm of the printing medium 15 at the instant when the printing medium 15 is inserted between the photosensitive drum 11 and the transfer roller 13 even if a given current value is supplied to the transfer roller 13 to detect the variation of the voltage Vtr. This is described more in detail with reference to FIG. 13.

FIG. 13 is a waveform showing the variation of voltage Vtr when a given current is supplied to the transfer roller 13. It is understood from FIG. 13 that it takes time until the voltage is stabilized after the insertion of the print medium 15. Accordingly, since printing operation starts shortly after the insertion of the medium in the electrophotographic recording apparatus having high printing speed, the medium reaches the printing area before the voltage $V_{tr}$ is stabilized and consequently the voltage difference becomes an error.

To overcome this problem, the resistance value of the printing medium 15 is calculated in the following manner.

In the equivalent circuit as shown in FIG. 12, if the resistance Rd of the photosensitive drum 11 is too small compared with other resistances to be neglected, a current characteristic as shown in a graph in FIG. 14 is obtained.

FIG. 14 is a graph showing variation of current which flows to the transfer roller 13 at the time of insertion of the medium.

The current value is the one when the voltage V0 is applied to the transfer roller 13 and it can be detected by the detection signal SG2.

The variation of current i at a detecting point (1) corresponding to the medium inserting time (t=0) is expressed as follows.

$$i = -\frac{V_0}{(R_r + R_m)\cdot R_r}\cdot\left(Rr + Rm\cdot e^{-\frac{t}{\tau}}\right)$$

the variation of the current $\frac{di}{dt}$ is expressed as follows.

$$\frac{di}{dt} = -\frac{V_0\cdot R_m}{(R_r + R_m)\cdot R_r}\cdot\frac{1}{\tau}\cdot e^{-\frac{t}{\tau}}$$

Assuming that current variation is A1 and current value is B1 at the detecting point (1), and current variation is A2 and current value is B2 at a detecting point (2) (an arbitrary time before the current is stabilized and expressed as t=t1), the following expressions are established.

$$A1 = -\frac{V_0\cdot R_m}{(R_r + R_m)\cdot R_r}\cdot\frac{1}{\tau} \quad \text{(a)}$$

-continued $$B1 = \frac{V_0}{P_r} \quad \text{(b)}$$

$$A2 = -\frac{V_0 \cdot R_m}{(R_r + R_m) \cdot R_r} \cdot \frac{1}{\tau} \cdot e^{-\frac{t1}{\tau}} \quad \text{(c)}$$

$$B2 = \frac{V_0}{(R_r + R_m) \cdot R_r} \cdot (R_r + R_m \cdot e^{-\frac{t1}{\tau}}) \quad \text{(d)}$$

From the expression of (a), the expression of (c) is expressed as follows.

$$\text{Since } A2 = A1 \cdot e^{-\frac{t1}{\tau}}, \quad \text{(c')}$$

$$e^{-\frac{t1}{\tau}} = \frac{A_2}{A_1}$$

From the expression of (c'), the expression of (d) is expressed as follows.

$$B2 = \frac{V_0}{(R_r + R_m) \cdot R_r} \cdot \left( R_r + \frac{A_2}{A_1} \cdot R_m \right) \quad \text{(d')}$$

Therefore, the following expression is established.

$$Rm = \frac{\frac{B2}{V_0} R_r - 1}{\frac{A_2}{A_1} - \frac{B_2}{V_0}} \quad \text{(d")}$$

By substitution of the expression of (b) into the expression of (d"), the following expression is established.

$$Rm = \frac{\frac{B_2}{B_1} - 1}{\frac{A_2}{A_1} - \frac{B_2}{V_0}}$$

Thus, it is possible to calculate the current value before the print medium 15 is inserted, the current value at an arbitrary time t1 before the current is stabilized, and the equivalent resistance Rm of the medium before the current value is stabilized by the output voltage V0 applied thereto.

A concrete control will be described hereinafter.

At first, the current value is measured before the insertion of the printing medium 15 (B1) and is again measured twice a little later thereafter, to obtain the variation rate (A1) of current from the difference between the two current values and the time lag therebetween.

Then, the current value is twice measured also at arbitrary times before the printing medium 15 reaches the printing position, and the variation rate (A2) of current is obtained by the difference between the two current values and the time lag therebetween. Average current value of these current values or one of the current values is assumed to be a current value (B2) at this time. It is preferable to use the average value when the current values B1 and the B2 are obtained but one of the current values may be used since the variation of the current value at this time is small compared with the current value per se.

Next, the resistance value of the printing medium 15 is calculated from the above formula before the printing medium 15 reaches the printing position and the calculated resistance value of the printing medium 15 is added to the resistance value of the transfer roller 13 obtained from the current value before the insertion of the printing medium 15 so as to obtain the optimum transfer voltage corresponding to the composed resistance value from a table which is the calculation table of the first embodiment modified by changing a search key so that the voltage values may be obtain from the resistance values or obtain the optimum transfer voltage from a formula. The high voltage power supply circuit 48 is controlled so as to apply the optimum transfer voltage to the transfer roller 13.

As described above, it is possible to obtain an optimum transfer voltage, even in a high-speed electrophotographic printer incapable of directly measuring the resistance of the print medium, since the resistance of the medium can be calculated from the current value and current variation measured before printing.

The PWM signal is used as a control signal by the high voltage power supply circuits 48 and 48-2 according to the first and second embodiments, but the output voltage may be directly subjected to digital feedback control.

Fourth Embodiment (FIG. 15)

FIG. 15 is a circuit diagram of a high voltage power supply circuit according to a fourth embodiment of the present invention.

In FIG. 15, the high voltage power supply circuit includes a sensor coil L3 for monitoring the output voltage, which is reduced by a voltage divider constituted of resistors R70 and R71 to be input to one input terminal of a comparator 68. The other input terminal of the comparator 68 is connected to a desired reference voltage which is output from a D/A converter 64 of a one-chip microcomputer 60. The comparator 68 outputs a logical "H" when a detected voltage is higher than the reference voltage and outputs a logical "L" when the detected voltage is lower than the reference voltage. The output of the comparator 68 is input to the input terminal of a three-input AND circuit 69. Other input terminals of the AND circuit 69 are connected to a signal line coupled to an I/O port 66 of the one-chip microcomputer 60 and an output of an oscillator circuit 67. When the one-chip microcomputer 60 turns on high voltage output control, a logical "H" is output from the I/O 66. If the comparator 68 is at logical "H" at that time, the AND circuit 69 outputs a clock generated by the oscillation circuit 67. So long as the clock of the oscillator circuit 67 is applied to the transistor Tr1, a power is supplied to the transformer T1 so that the high voltage is output therefrom as V0.

The output current is converted into a voltage by a current-voltage converter circuit comprising resistors R73, R74, R75 and an operational amplifier 81 and the converted voltage is input to the A/D converter 65 of the one-chip microcomputer 60 to be monitored thereby.

The one-chip microcomputer 60 includes a CPU 61, a RAM 62 and a ROM 63 and it is connected to the CPU-LSI 28 by way of the I/O 66.

Using the high voltage supply power circuit according to the embodiments of the present invention, it is possible to perform an excellent printing without lowering the output voltage even in the electrophotographic recording apparatus which consumes much current for high speed printing.

What is claimed is:

1. An electrophotographic recording apparatus including a photosensitive drum and a transfer roller confronting said photosensitive drum, said electrophotographic recording apparatus further comprising:

a high voltage power supply circuit for applying a transfer voltage to said transfer roller; and a control circuit for receiving information of said electrophotographic recording apparatus including information of an output current value of said high voltage power supply circuit and controlling a voltage value output from said high voltage power supply circuit;

wherein said control circuit calculates a value corresponding to a voltage value to be applied to said transfer roller based on a value which is varied in correspondence with a resistance value of said transfer roller and a resistance value of a print medium and outputs a control signal for controlling said voltage value which is supplied by said high pressure power supply circuit based on the calculated value;

wherein said control circuit receives a set value of an operation panel and calculates a value which is varied corresponding to the resistance value of said transfer roller and the resistance value of said medium and also calculates a value corresponding to said voltage value to be applied to said transfer roller based on the set value of said operation panel.

2. An electrophotographic recording apparatus according to claim 1, wherein said control circuit further receives an output of a medium sensor and calculates a width of said print medium based on an output of said medium sensor and calculates a value which is varied in response to said resistance value of said transfer roller and said resistance value of said print medium and a value corresponding to said voltage value to be applied to said transfer roller based on the width of said print medium. also calculates a value corresponding to said voltage value to be applied to said transfer roller based on the set value of said operation panel.

3. An electrophotographic recording apparatus according to claim 1, wherein said electrophotographic recording apparatus includes a memory device which stores therein information for operating said control circuit, and wherein said control circuit reads a formula for calculating said value from said memory device and calculates said value based on said formula.

4. An electrophotographic recording apparatus according to claim 1, wherein said electrophotographic recording apparatus includes a memory device which stores therein information for operating said control circuit, and wherein said control circuit calculates said value referring to a calculation table which is stored in said memory device.

5. The electrophotographic recording apparatus of claim 4 wherein the printing medium has one of a plurality of different sizes, and wherein the control circuit calculates the value referring to one of a plurality of calculation tables stored in the memory device, each calculation table corresponding to a different printing medium size.

6. The electrophotographic recording apparatus of claim 4 wherein the printing medium is one of a plurality of different types, and wherein the control circuit calculates the value referring to one of a plurality of calculation tables stored in the memory device, each calculation table corresponding to a different printing medium type.

7. A method of transferring toner image in an electrophotographic recording apparatus which includes a photosensitive drum and a transfer roller confronting the photosensitive drum, said method comprising the steps of:

measuring a resistance value of said transfer roller before a print medium is introduced into said electrophotographic recording apparatus;

inserting said print medium between said photosensitive drum and said transfer roller;

detecting a first current value B1 at a first time immediately after said print medium is inserted between said photosensitive drum and said transfer roller and a variation of said first current value A1 which is varied during a very short period of time close to said first time while a constant voltage V0 is applied to said transfer roller;

detecting a second current value B2 at a second time before the variation of said current comes to an end after said first time and a variation of said second current value A2 which is varied during a very short period time close to said second time;

calculating a resistance value Rm of said print medium using a calculation formula:

$$Rm=\{(B2/B1)-1\}/\{(A2/A1)-(B2/V0)\};\text{ and}$$

applying a voltage value to said transfer roller, said voltage value corresponding to a combined resistance of the resistance value of said transfer roller and the resistance value of said print medium.

8. An electrophotographic recording apparatus including a photosensitive drum and a transfer roller confronting the photosensitive drum, the electrophotographic recording apparatus further comprising:

a high voltage power supply circuit for applying a transfer voltage to the transfer roller; and a control circuit for receiving information of the electrophotographic recording apparatus including information of an output current value of the high voltage power supply circuit and controlling a voltage value output from the high voltage power supply circuit;

wherein the control circuit calculates a value corresponding to a voltage value to be applied to the transfer roller based on a value which is varied in correspondence with a resistance value of the transfer roller and a resistance value of a print medium and outputs a control signal for controlling the voltage value which is supplied by the high pressure power supply circuit based on the calculated value;

the control circuit including a pulse width modulation signal generator for outputting the control signal to the high voltage power supply circuit so as to control a voltage of the high voltage power supply circuit based on a pulse width of the control signal;

the high voltage power supply circuit including:

a transformer composed of a first coil having a first number of turns and a second coil having a second number of turns which is greater than the first number of turns;

a switching element for receiving an output signal of the pulse width modulation signal generator and for controlling current to be supplied to the first coil;

a smoothing circuit connected to the second coil; and a first detection terminal for outputting a voltage value in response to a current value supplied from the high voltage power supply circuit.

9. The electrophotographic recording apparatus of claim 8 wherein the control circuit further receives an output of a medium sensor and calculates a width of the print medium based on an output of the medium sensor and calculates a value which is varied in response to the resistance value of the transfer roller and the resistance value of the print medium and a value corresponding to the voltage value to be applied to the transfer roller based on the width of the print medium.

10. The electrophotographic recording apparatus of claim 8 wherein the electrophotographic recording apparatus includes a memory device which stores therein information for operating the control circuit, and wherein the control circuit reads a formula for calculating the value from the memory device and calculates the value based on the formula.

11. The electrophotographic recording apparatus of claim 8 wherein the electrophotographic recording apparatus includes a memory device which stores therein information for operating the control circuit, and wherein the control circuit calculates the value referring to a calculation table which is stored in the memory device.

12. The electrophotographic recording apparatus of claim 11 wherein the printing medium has one of a plurality of different sizes, and wherein the control circuit calculates the value referring to one of a plurality of calculation tables stored in the memory device, each calculation table corresponding to a different printing medium size.

13. The electrophotographic recording apparatus of claim 11 wherein the printing medium is one of a plurality of different types, and wherein the control circuit calculates the value referring to one of a plurality of calculation tables stored in the memory device, each calculation table corresponding to a different printing medium type.

14. The electrophotographic recording apparatus of claim 8 wherein the high voltage power supply circuit further includes a second detection terminal for outputting a voltage value corresponding to the voltage value supplied from the high voltage power supply circuit.

15. The electrophotographic recording apparatus of claim 14 wherein the control circuit further receives an output of a medium sensor and calculates a width of the print medium based on an output of the medium sensor and calculates a value which is varied in response to the resistance value of the transfer roller and the resistance value of the print medium and a value corresponding to the voltage value to be applied to the transfer roller based on the width of the print medium.

16. The electrophotographic recording apparatus of claim 14 wherein the electrophotographic recording apparatus includes a memory device which stores therein information for operating the control circuit, and wherein the control circuit reads a formula for calculating the value from the memory device and calculates the value based on the formula.

17. The electrophotographic recording apparatus of claim 14 wherein the electrophotographic recording apparatus includes a memory device which stores therein information for operating the control circuit, and wherein the control circuit calculates the value referring to a calculation table stored in the memory device.

18. An electrophotographic recording apparatus comprising:

a photosensitive drum;

a transfer roller confronting the photosensitive drum;

a high voltage power supply circuit for applying a transfer voltage to the transfer roller, the high voltage power supply circuit having:

a transformer including a primary coil with a first number of turns and a secondary coil with a second number of turns larger than the first number of turns;

capacitor means connected to the primary coil in parallel; and a switching element connected to the primary coil in series; and a control circuit for receiving information of the electrophotographic recording apparatus including information of an output current value of the high voltage power supply circuit and for controlling a voltage value output from the high voltage power supply circuit;

wherein the control circuit calculates a value corresponding to a voltage value to be applied to the transfer roller based on a value which is varied in correspondence with a resistance value of the transfer roller and a resistance value of a print medium, and outputs a control signal for pulse width modulation control of the voltage value output from the high voltage power supply circuit based on the calculated value.

19. The electrophotographic recording apparatus of claim 18 wherein the switching element is connected in parallel to a dumping means.

20. The electrophotographic recording apparatus of claim 18 wherein the dumping means is an inversely connected diode element.

21. The electrophotographic recording apparatus of claim 18 wherein the control circuit further receives an output of a medium sensor and calculates a width of the print medium based on an output of the medium sensor and calculates a value which is varied in response to the resistance value of the transfer roller and the resistance value of the print medium and a value corresponding to the voltage value to be applied to the transfer roller based on the width of the print medium.

22. The electrophotographic recording apparatus of claim 18 wherein the electrophotographic recording apparatus includes a memory device which stores therein information for operating the control circuit, and wherein the control circuit reads a formula for calculating the value from the memory device and calculates the value based on the formula.

23. The electrophotographic recording apparatus of claim 18 wherein the electrophotographic recording apparatus includes a memory device which stores therein information for operating the control circuit, and wherein the control circuit calculates the value referring to a calculation table stored in the memory device.

24. The electrophotographic recording apparatus of claim 23 wherein the printing medium has one of a plurality of different sizes, and wherein the control circuit calculates the value referring to one of a plurality of calculation tables stored in the memory device, each calculation table corresponding to a different printing medium size.

25. The electrophotographic recording apparatus of claim 23 wherein the printing medium is one of a plurality of different types, and wherein the control circuit calculates the value referring to one of a plurality of calculation tables stored in the memory device, each calculation table corresponding to a different printing medium type.

26. The electrophotographic recording apparatus of claim 18 wherein the control circuit receives a set value of an operation panel and calculates a value which is varied corresponding to the resistance value of the transfer roller and the resistance value of the medium and also calculates a value corresponding to the voltage value to be applied to the transfer roller based on the set value of the operation panel.

27. The electrophotographic recording apparatus of claim 18 wherein the high voltage power supply circuit comprises:

a transformer composed of a first coil having a first number of turns and a second coil having a second number of turns which is greater than the first number of turns;

a switching element for receiving an output signal of the pulse width modulation signal generator and for controlling current to be supplied to the first coil;

a smoothing circuit connected to the second coil; and a first detection terminal for outputting a voltage value in response to a current value supplied from the high voltage power supply circuit.

28. The electrophotographic recording apparatus of claim 27 wherein the high voltage power supply circuit further includes a second detection terminal for outputting a voltage value corresponding to the voltage value supplied from the high voltage power supply circuit.

* * * * *